US011730256B2

(12) United States Patent
Hayes

(10) Patent No.: US 11,730,256 B2
(45) **Date of Patent: *Aug. 22, 2023**

(54) FINGER GRIP

(71) Applicant: DGIP LLC, Boulder, CO (US)

(72) Inventor: William Donald Hayes, Pinehurst, NC (US)

(73) Assignee: DGIP LLC, Boulder, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/107,210

(22) Filed: Nov. 30, 2020

(65) Prior Publication Data

US 2021/0076810 A1 Mar. 18, 2021

Related U.S. Application Data

(62) Division of application No. 15/576,418, filed as application No. PCT/US2016/033772 on May 23, 2016, now Pat. No. 10,849,413.

(60) Provisional application No. 62/165,420, filed on May 22, 2015.

(51) Int. Cl.
*A45F 5/10* (2006.01)
*A45F 5/00* (2006.01)

(52) U.S. Cl.
CPC ..... *A45F 5/10* (2013.01); *A45F 5/00* (2013.01); *A45F 2200/0508* (2013.01); *A45F 2200/0516* (2013.01); *A45F 2200/0525* (2013.01); *A45F 2200/0533* (2013.01)

(58) Field of Classification Search
CPC ..... A45F 5/00; A45F 5/10; A45F 2200/0516; A45F 2200/0525; Y10T 16/476; Y10S 16/12; F16M 13/04; F16M 13/022
USPC ..... D14/251; 294/25
See application file for complete search history.

(56) References Cited

U.S. PATENT DOCUMENTS 1,664,257 A * 3/1928 McCullough ..... A63B 60/12 473/203
2,223,204 A * 11/1940 Ruth ..... A45D 29/22 132/73
3,868,110 A * 2/1975 Jones ..... A63B 60/08 473/551
4,754,499 A * 7/1988 Pirie ..... A41D 13/082 2/20
4,934,024 A * 6/1990 Sexton, I ..... A63B 60/12 16/421
4,977,621 A * 12/1990 Richard ..... A41D 13/082 2/161.1

(Continued)

*Primary Examiner* — Jeffrey O'Brien
(74) *Attorney, Agent, or Firm* — Yiu F. Au; Au Law Office, P.C.

(57) ABSTRACT

A finger grip is attachable to a handheld device for assisting a user in operating the handheld device. The finger grip includes one or more finger slots, where each finger slot includes an edge and is configured to accommodate one or more lower fingers of a hand of a user, and where the edge is configured to provide a rest to the lower finger accommodated by the respective finger slot. The finger grip further includes a back for attaching the finger grip to a back of the handheld device, allowing a thumb of the hand to have a reach on a range of the front of the handheld device when the lower fingers are accommodated by the finger slots in a position. The finger grip may further include a raised area configured for providing support to the hand.

20 Claims, 5 Drawing Sheets

(56) References Cited

U.S. PATENT DOCUMENTS 5,155,878 A * 10/1992 Dellis ..... B62K 21/26 16/421
5,251,380 A * 10/1993 Craig ..... B25G 1/102 16/421
5,560,375 A * 10/1996 Kabanek ..... A61F 5/3761 128/878
5,692,265 A * 12/1997 Dalury ..... B25D 1/00 16/421
5,799,369 A * 9/1998 Schulein ..... A47J 45/06 16/430
6,409,611 B1 * 6/2002 Louk, Jr. ..... A45B 9/02 473/286
8,428,664 B1 * 4/2013 Wyers ..... F16M 13/04 455/575.1
8,480,144 B2 * 7/2013 Potter ..... A45F 5/10 294/25
8,528,798 B2 * 9/2013 Chen ..... A45C 3/001 224/217
8,560,031 B2 * 10/2013 Barnett ..... F16M 13/00 455/575.8
D693,818 S * 11/2013 Webber ..... D14/439
8,672,374 B1 * 3/2014 Webber ..... F16M 13/00 294/25
8,827,234 B2 * 9/2014 Baker ..... G06F 1/1626 248/682
D716,287 S * 10/2014 Ambriz ..... D14/253
9,033,384 B2 * 5/2015 Potter ..... G06F 1/1628 294/25
D733,147 S * 6/2015 Stevens ..... D14/439
D735,695 S * 8/2015 Murphy ..... A45F 5/00 D14/217
D738,569 S * 9/2015 Saide ..... D27/165
9,198,307 B1 * 11/2015 Lacy ..... H05K 5/0086
9,204,711 B2 * 12/2015 Schaffer ..... A45F 5/00
9,226,567 B2 * 1/2016 Potter ..... F16M 13/022
9,486,910 B2 * 11/2016 Stevens ..... F16M 11/041
D777,154 S * 1/2017 McGowan ..... D14/250
9,653,934 B2 * 5/2017 Forristall ..... H02J 7/342
9,674,324 B1 * 6/2017 Duphiney ..... H04M 1/0281
9,800,703 B2 * 10/2017 Roux ..... H04B 1/3888
9,838,519 B1 * 12/2017 Blackwood ..... H04M 1/0281
10,001,243 B2 * 6/2018 Cavalcante ..... A45F 5/00
10,213,010 B2 * 2/2019 Pearce ..... B25G 1/102
10,231,525 B2 * 3/2019 Masjedi ..... A45C 13/26
10,244,856 B1 * 4/2019 Horsky ..... A46B 5/023
D854,005 S * 7/2019 Hayes ..... A45F 5/00 D14/251
10,966,510 B2 * 4/2021 Freimuth ..... H04B 1/3888
2006/0137144 A1 * 6/2006 Tillim ..... A63B 60/08 16/430
2008/0276395 A1 * 11/2008 Powell ..... B24D 15/045 15/143.1
2009/0207052 A1 * 8/2009 Powell ..... A47L 13/16 341/20
2009/0270050 A1 * 10/2009 Brown ..... H04B 1/3833 455/90.3
2011/0054734 A1 * 3/2011 Dale ..... G06F 3/0216 701/36
2011/0084081 A1 * 4/2011 Chung ..... A45C 13/26 220/628
2011/0266313 A1 * 11/2011 Ghalib ..... A45F 5/00 224/101
2012/0000001 A1 * 1/2012 Powell ..... A41D 13/082 2/20
2012/0042476 A1 * 2/2012 Karmatz ..... B25G 1/102 16/421
2012/0043452 A1 * 2/2012 Karmatz ..... B25G 1/04 248/558
2012/0110787 A1 * 5/2012 Quiggins ..... B25G 1/102 16/430
2012/0305445 A1 * 12/2012 Hu ..... A45F 5/00 206/775
2012/0319414 A1 * 12/2012 Potter ..... G06F 1/1628 294/25
2013/0012791 A1 * 1/2013 Coles ..... A61B 5/01 600/301
2013/0057005 A1 * 3/2013 Grieve ..... A47G 23/0625 294/172
2013/0180084 A1 * 7/2013 Edson ..... A45B 9/02 16/430
2013/0270851 A1 * 10/2013 Konyha ..... F16M 13/04 294/142
2013/0277992 A1 * 10/2013 Senoff ..... A45F 5/00 294/25
2014/0203159 A1 * 7/2014 Muhammad ..... A47B 23/002 248/444
2014/0319190 A1 * 10/2014 Cao ..... A45F 5/00 224/218
2015/0054297 A1 * 2/2015 Schaffer ..... A45F 5/00 294/137
2015/0197306 A1 * 7/2015 Denby ..... B62K 21/26 74/551.9
2016/0049983 A1 * 2/2016 Ripka ..... H04M 1/04 455/575.6
2016/0233909 A1 * 8/2016 West ..... H04B 1/385
2017/0079416 A1 * 3/2017 Mick ..... A45F 5/00
2017/0241590 A1 * 8/2017 Boubli ..... F16M 11/041
2018/0295976 A1 * 10/2018 Tremaine ..... A45C 11/00

* cited by examiner

FINGER GRIP

CROSS REFERENCE TO RELATED APPLICATIONS

This application is a divisional of U.S. application Ser. No. 15/576,418 filed Nov. 22, 2017, which is a national stage application, under 35 U.S.C. § 371, of International Application No. PCT/US16/33772 having an international filing date of May 23, 2016, which claims the benefit under U.S.C. § 119(e) of U.S. Provisional Application No. 62/165,420, filed May 22, 2015; each of the above-identified applications being fully incorporated herein by reference.

BACKGROUND OF THE INVENTION

Field of the Invention

The present invention generally relates to a finger grip, and more particularly to an apparatus and method for a finger grip for a handheld device.

Description of the Related Art

A handheld device includes a number of small computing devices that are small enough to be portable and/or held by a user while in operation (e.g., can conveniently be stored in a sufficiently sized pocket and used while fitting in the palm of the user). A handheld device may include tablet and other mobile computers, mobile and smart phones, calculators, handheld game consoles, portable media players, still or video cameras, personal navigation devices, and other mobile devices.

Present handheld or mobile devices are becoming powerful in terms of their computing power, and handheld devices are becoming acceptable replacements for larger desktop or even laptop computers as handheld devices are able to perform many of the same functions as with the larger computers. A generic handheld device may include a touch screen that acts both for the display output and the input (e.g., a user may input by directly touching contents on the touch screen or through a range of motions and/or gestures on the touch screen, a user may also input through a virtual keyboard displayed on the touch screen) similar to larger computers.

There are deficiencies with the related art. While handheld devices may include the functionalities of larger devices with more convenience (e.g., due to portability), there may be difficulties in realizing the convenience when operating the handheld devices due to a possible need to hold the handheld device (e.g., with one or both hands), thereby preventing or at least limiting a higher ability to input on the handheld device (e.g., tapping, typing, gesture, motions) while the hand is occupied to hold the handheld device. There may also be further limit on realizing further convenience when operating the handheld device such as a need to operate the handheld device with only one hand (e.g., the hand holding the handheld device) while the other hand may be occupied by another task.

Another deficiency is that handheld devices may be of various different shapes and sizes, and the non-uniformity in the shapes and sizes may make certain handheld devices unwieldy for certain users' hands. Further, larger handheld devices may be further unwieldy for users with smaller hands.

SUMMARY OF THE INVENTION

Accordingly, the invention is directed to a finger grip for handheld devices that substantially obviate one or more of the problems due to limitations and disadvantages of the related art.

An advantage of an embodiment is to provide convenient operation of a handheld device for a user while the user is holding the handheld device. A further advantage is to provide one-handed operation on the handheld device using the same hand that is holding the handheld device.

Another advantage of an embodiment is to facilitate a user's operation of a handheld device that is sized or shaped non-optimally for the user, allowing the user a larger selection of choices in handheld devices for his or her usage. For example, an embodiment may allow a user with smaller hands to be able to operate a larger handheld device that it would otherwise be able to use.

Yet another advantage of an embodiment is to provide for comfort and aesthetics on the handheld device while the finger grip is attached to the handheld device. A further advantage is to provide for simplicity and naturalness in the installation of the finger grip to the handheld device or in the usage of the finger grip on the handheld device. Another further advantage is to allow for convenient storage of the handheld device with the finger grip attached.

Yet another advantage of an embodiment is to provide for a natural stand for the handheld device in addition to the finger grip function while without increasing the size of the finger grip.

Additional features and advantages of the invention will be set forth in the description which follows, and in the art will be apparent from the description, or may be learned by practice of the invention. The objectives and other advantages of the invention will be realized and attained by the structure particularly pointed out in the written description and claims hereof as well as the appended figures.

According to an embodiment, a finger grip attachable to a handheld device includes one or more finger slots, where each finger slot includes an edge and is configured to accommodate one or more lower fingers of a hand of a user, and where the edge is configured to provide a rest to the lower finger accommodated by the respective finger slot. The finger grip further includes a back of the finger grip for attaching the finger grip to a back of the handheld device, where a thumb of the hand has a reach on a range of the front of the handheld device when the lower fingers are accommodated by the finger slots in a position. The finger grip further includes a raised area configured for providing support to the hand. The finger slots are arranged at an angle. The back of the finger grip comprises an attachment for attaching the finger grip to the back of the handheld device, the attachment being one or more of: an adhesive attachment, a glue attachment, a magnetic attachment, and a hook-and-loop attachment. The finger grip further includes material being one or more of: foam, memory foam, and plastic. The finger grip comprises a composite material. The finger grip is configured to be attached to the back of the handheld device at an angle to a side of the handheld device. The finger grip is configured to be attached to the handheld device for a right hand or a left hand of the user. The finger grip further includes a design for a type of user.

In another embodiment, a method for assisting a user in operating a handheld device includes providing a finger grip for attachment to the handheld device, the finger grip comprising one or more finger slots, where each finger slot comprising an edge and a back of the finger grip for attaching the finger grip to a back of the handheld device, and attaching the finger grip to the back of the handheld device at a position where each finger slot is able to accommodate one or more lower fingers of a hand of the user, the edge of the respective finger slot accommodating the respective lower finger is able to provide a rest to the respective lower finger, and a thumb of the hand has a reach on a range of the front of the handheld device when the lower fingers are accommodated by the finger slots. The range includes a soft keypad area of a touch screen of the handheld device. The method further includes supporting the hand with a raised portion of the finger grip. The attaching includes attaching a back of the finger grip to the handheld device using one or more of: an adhesive attachment, a glue attachment, a magnetic attachment, and a hook-and-loop attachment. The attaching includes attaching the finger grip to the handheld device at an angle relative to a side of the handheld device. The attaching includes orienting the finger grip to the handheld device for operation for a right hand or a left hand.

In yet another embodiment, a kit for attaching a finger grip to a small or handheld object includes the finger grip. The finger grip includes one or more finger slots, where each finger slot includes an edge and is configured to accommodate one or more lower fingers of a hand of a user, and where the edge is configured to provide a rest to the lower finger accommodated by the respective finger slot. The finger grip further includes a back of the finger grip for attaching the finger grip to a back of the object, where a thumb of the hand has a reach on a range of the front of the object when the lower fingers are accommodated by the finger slots in a position. The kit further includes instructions for attaching the finger grip to the object. The instructions include one or more pre-determined orientation or position on the back of the object for the finger grip. The finger grip further includes a raised area configured for providing support to the hand. The back of the finger grip includes an attachment for attaching the finger grip to the back of the handheld device, the attachment being one or more of: an adhesive attachment, a glue attachment, a magnetic attachment, and a book-and-loop attachment. The instructions include a video.

It is to be understood that both the foregoing general description and the following detailed description are exemplary and explanatory and are intended to provide further explanation of the invention as claimed.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

It shall be understood that the term "means," as used herein, shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials or acts and the equivalents thereof shall include all those described in the summary of the invention, brief description of the drawings, detailed description, abstract, and claims themselves.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible, utilizing, alone or in combination, one or more of the features set forth above or described in detail below.

BRIEF DESCRIPTION OF THE FIGURES

The accompanying figures, which are included to provide a further understanding of the invention are incorporated in and constitute a part of this specification, illustrate embodiments of the invention and together with the description serve to explain the principles of the invention.

DETAILED DESCRIPTION

Reference will now be made in additional detail to an embodiment of the present invention, example of which is illustrated in the accompanying figures.

Figure 1:
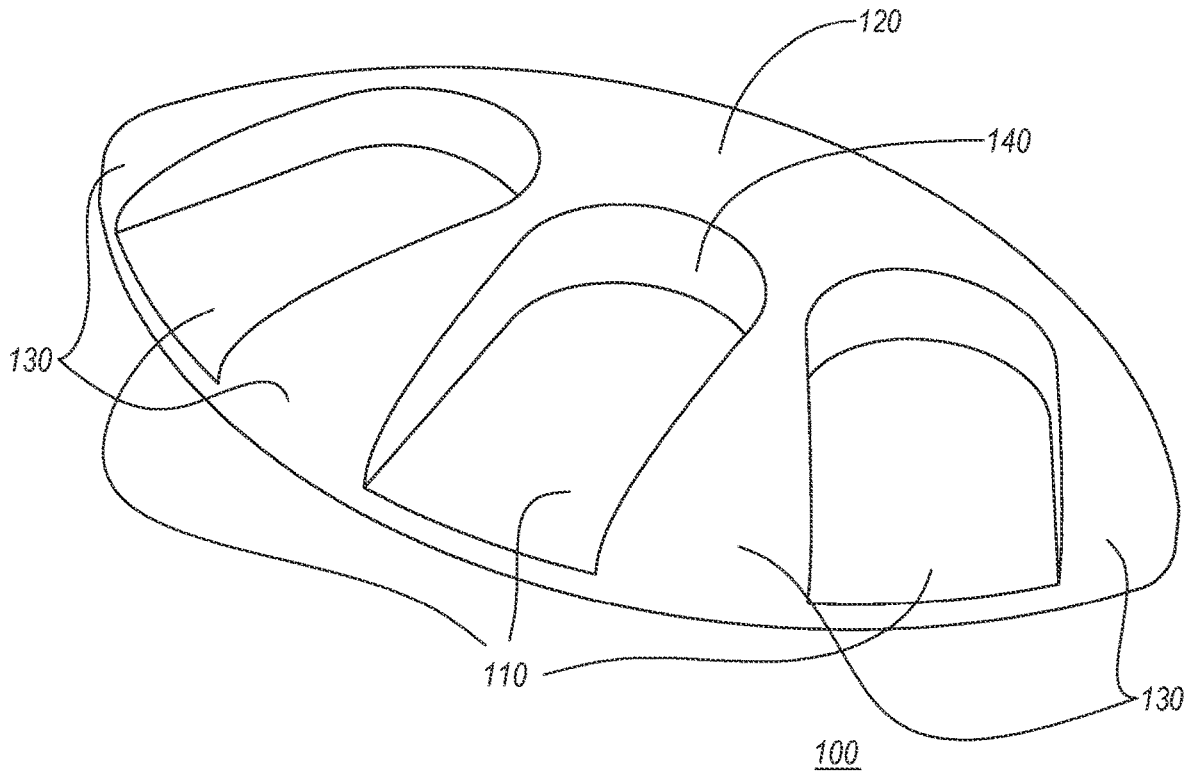
FIG. 1 illustrates an exemplary perspective view of the top and front of a finger grip according to an embodiment.

FIG. 1 illustrates an exemplary perspective view of the top and front of a finger grip according to an embodiment.

Referring to FIG. 1, the finger grip 100 may be a material shaped to include finger slots 110. Each finger slot 110 is sized and shaped to allow the secure placement and support of at least one finger of the user. In a preferred embodiment, the finger grip 100 may include 3 finger slots 110 for accommodating 3 separate fingers of the same hand of the user. In alternate embodiments, the finger grip 100 may contain various numbers of finger slots 110 (e.g., 1-4 finger slots) and each finger slot 110 may accommodate the placement of more than one finger. In another embodiment, the number of finger slots 110 may be 2 to more than 4 to accommodate the placement of fingers of the user's hand of varying sizes and shape, and not every finger slot 110 may be require to have the placement of a finger (e.g., a finger grip 100 having 5 finger slots 110 but the user may place fingers only on the finger slots 110 that allows the most comfort and/or stability when holding the finger grip 100).

In an embodiment, each finger slot 110 may be separated by separations 130, which work to define the separation space and angle between each finger slot 110. For example, the separations 130 may be defined such that when the user's fingers are placed in the finger slots 110, the fingers (in conjunction with the user's hand) are spread out enough to provide ample support for holding the handheld device while the separations 130 is small enough to accommodate the comfort of the user's fingers and hand while placed in the finger slots 110 and holding the handheld device. In a preferred embodiment, each finger slot 110 is arranged and aligned in 35 degree angles from each other, the width of each finger slot 110 is 0.625" to 0.725" (e.g., the width may be variable along the length of the finger slot 110), and the separations 130 is sized and shaped to separate the finger slots 110 (e.g., the separations 130 fills the space between each finger slot 110 when the finger slots 110 are arranged and aligned in 35 degree angles from each other in an arc of a hypothetical circle with a radius of 2.639"). In alternative embodiments, the finger slots 110 and the separations 130 may be sized, shaped, arranged, and aligned in other measurements and dimensions as suitable for the user. In another embodiment, the finger slots 110 and the separations 130 may be customized for a particular user (e.g., measuring the user prior to the fabrication of the finger grip 100 or shaped prior to or during the use of the finger grip 100 for a user (e.g., the finger grip 100 being made of a shapeable material)) or may be pre-fabricated to fit a variety of users depending on hand and finger size, strength, dexterity, or other factors.

In an embodiment, the interior of the finger slots 110 (where the user places his or her fingers) may be further filled with a material (e.g., foam, rubber, plastic, or other materials) for providing further comfort and/or friction to the placed fingers.

In an embodiment, each finger slot 110 may include a relatively vertical edge 140 for accommodating the placement and resting of the user's finger. For example, when the user's finger is placed into a finger slot 110, the tip and/or the top portion of the user's finger (including the portion containing the fingerprint) may rest on the edge 140. As such, the edge 140 acts as a stop for the user's fingers to facilitate the user is holding onto the finger grip 100 (and the handheld device attached to the finger grip 100) when the user's fingers are in the finger slots 110 and is undergoing a natural gripping motion in the finger slots 110 (the user's fingers gripping towards the palm of the hand), thereby facilitating the security of the user's fingers' hold onto the finger grip 100 naturally with minimal determined effort on the part of the user. In turn, the user's deliberate release of the gripping motion releases the user's hold on to the finger grip 100. As such, the finger grip 100 provides a simple and intuitive operation for the user. In a preferred embodiment, the edge 140 is 0.375" in height. In alternative embodiments, the edge may be of a height suitable for the tip and/or the top portion of the user's fingers. In another embodiment, the height of the edge 140 may be different for their respective finger slots 110. For example, a finger slot 110 in the middle of the finger grip 100 may have a larger height for the edge 140 than a finger slot 110 towards the side of the finger grip 100 (e.g., to be consistent with a finger grip 100 that is rounded towards the side for better aesthetics, comfort, and/or other factors).

In an embodiment, the finger grip may include a raised portion 120 in the spaces of the front of the finger grip 100 behind the finger slots 110 and the edge 140. The top portion 120 may be rounded and have a height suitable for supporting the user's palm and the lower ends of the user's finger when the user's fingers are placed into the finger slots 110 (and the fingers may be supported by the edge 140 as discussed above) for further improving user comfort when using the finger grip 100. In a preferred embodiment, the raised portion 120 has a height of 0.375' at the maximum point.

In an embodiment, the finger grip 100 may be made from soft materials (e.g., foam, rubber, plastic, or other materials) for the comfort of the user. Soft and compressible materials also allows for better grip and easier storage. In a further embodiment, the finger grip 100 may be made from memory materials (e.g., memory foam) that allows a somewhat customization to the fingers of the particular user. In another embodiment, the finger grip 100 may be made of an amalgamation of materials.

FIGS. 2A-2D illustrate exemplary views of a finger grip attached to handheld devices according to embodiments.

Referring to FIGS. 2A-2D, the finger grip 100 may be attached to handheld devices of various sizes (e.g., mobile phone 210 and 240, handheld and/or tablet devices 220 and 230). In an embodiment, the back of the finger grip 100 (e.g., the side of the finger grip 100 opposite to the front side that includes the finger slots 110 and the raised portion 120) may be flat and may include an adhesive, magnetic, hook-and-loop fastener, glue, or other material for attaching the finger grip 100 to the handheld devices 210-240.

It is noted that using hand-held mobile devices with one hand is difficult; this is especially true of larger devices (e.g., handheld devices 220 and 230) or for individuals with small hands.

In an embodiment, the finger grip 100 is configured to allow the fingers of the user to naturally grip devices in a way that allows for easier one-handed use based on the design and placement of the finger grip 100 with respect to the back of the handheld device (e.g., handheld devices 210-240). The soft and compressible yet gripping design allows for easier storage than other products. A natural placement of the finger grip 100 with respect to the handheld device fitted for a user's hand and fingers allows for an almost seamless operation.

According to an embodiment, the finger grip 100 may be attached to a handheld device as follows. The finger grip 100 may be attached to the back of the handheld device (the opposite side from the touch screen) such that the user's lower fingers (e.g., the index finger, the middle finger, the ring finger, and/or the pinky) would naturally be placed into the finger slots 110 while the thumb would naturally have a range of movement in the front of the handheld device over the touch screen. One exemplary position of the user's hand is a natural hand position when the user is grabbing and holding onto the handheld device from the side of the device. With the finger grip 100, the user will curl one or more of his or her lower fingers into a respective finger slot 110 (to secure the user's grip onto the handheld device attached to the finger grip 100). The user's thumb is thereby moveable across the touch screen of the handheld device for touching the touch screen and providing input to the handheld device through the touch screen.

It is noted that an available range of movement of the thumb across the touch screen depends on the size of the handheld device (and/or the respective touch screen), the size of the user's hand and/or the range of motion of the thumb, the position of the finger grip 100 as it is being grabbed or anchored by the user's lower fingers.

In an embodiment, for a smaller handheld device (and/or a respective smaller touch screen), the finger grip 100 may be attached to the handheld device at a position towards the lower end of the handheld device. As such, the thumb, being higher than the lower fingers on the hand, would naturally be positioned near the middle of the length of the touch screen, thereby the thumb has an increased reach (or possibly a reach) of the touch screen (e.g., as shown on handheld devices 210 or 240).

In another embodiment, for a larger handheld device (and/or a respective larger touch screen), it may not be possible for the user's thumb to reach the full range of the touch screen. Here, the finger grip 100 may be positioned for optimal usage. For example, the finger grip 100 may be positioned such that the user's thumb would be able to reach at least a range where the user expects the most input activity (e.g., toward the bottom of the touch screen where the soft keyboard would most likely appear, e.g., as shown on handheld devices 220 or 230).

In an embodiment, the finger grip 100 may be orientated based on the dominant hand of the user (e.g., the hand where the user uses to input the touch screen). For example, for a right-handed user, the finger grip 100 may be orientated with the raised portion 120 towards the right edge of the handheld device (when the device is viewed from the front) and the edge 140 faces towards the left edge of the handheld device. As such, the user may grab the handheld device using the right hand from the right edge of the handheld device, and the finger grip 100 fits neatly into the user's right hand (e.g., the raised portion 120 supporting the lower portion of the fingers and/or the palm and the edge 140 supporting the tip and/or the top portion of the fingers). For a left-handed user, the finger grip 100 may be orientated with the raised portion 120 toward the left edge of the handheld device (when the device is viewed from the front) and the edge 140 faces towards the right edge of the handheld device.

In an embodiment, two opposite facing finger grips 100 may be attached to the handheld devices (e.g., one finger grip 100 oriented for a right-handed user and another finger grip 100 oriented for a left-handed user attached to the same handheld device) for flexibility in the dominant hand usage. In another embodiment, the finger grip may be manufactured to include both the right-handed and the left-handed orientation on the same finger grip. In a further embodiment, a finger grip 100 in a right handed attachment orientation may be used by the left hand (e.g., temporarily) even though the fingers (of the left hand) may not be as supported by the edge 140 (but may still have some support through a friction effect from the interior of the finger slots 110).

In an embodiment, the finger grip 100 may be attached to the handheld device at a slight angle deviation on the handheld device (e.g., the edge of the raised portion 120 and/or the edge 140 do not align perfectly parallel to the edge of the handheld device). This position may allow the user's thumb to have a better range of movement on the touch screen or a more comfortable position for the user's hand.

The finger grip 100 may be positioned as discussed above as fitted for a particular user prior to a more permanent attachment to the handheld device. In an embodiment, measurements and/or positional aids may be provided for easier and/or more convenient measurement and/or attachment of the finger grip 100 to the handheld device. For example, instructions, attachment aids such as pre-determined measurement dimensions and physical aids, or other aids may be provided to the user to use with the finger grip 100. The pre-determined measurements may be provided for known handheld devices (e.g., various known mobile phones, tablet computers, or other handheld devices) such that the user may have a recommended position and fit for the finger grip 100. The user may further customize the position and fit for the user's hand as discussed above using an initial position from the pre-determined measurements. The aids may include instructions of various forms, including documents and videos. A kit of the aids and the finger grip may be provided to help the user in attaching the finger grip to the handheld device.

Figure 4:
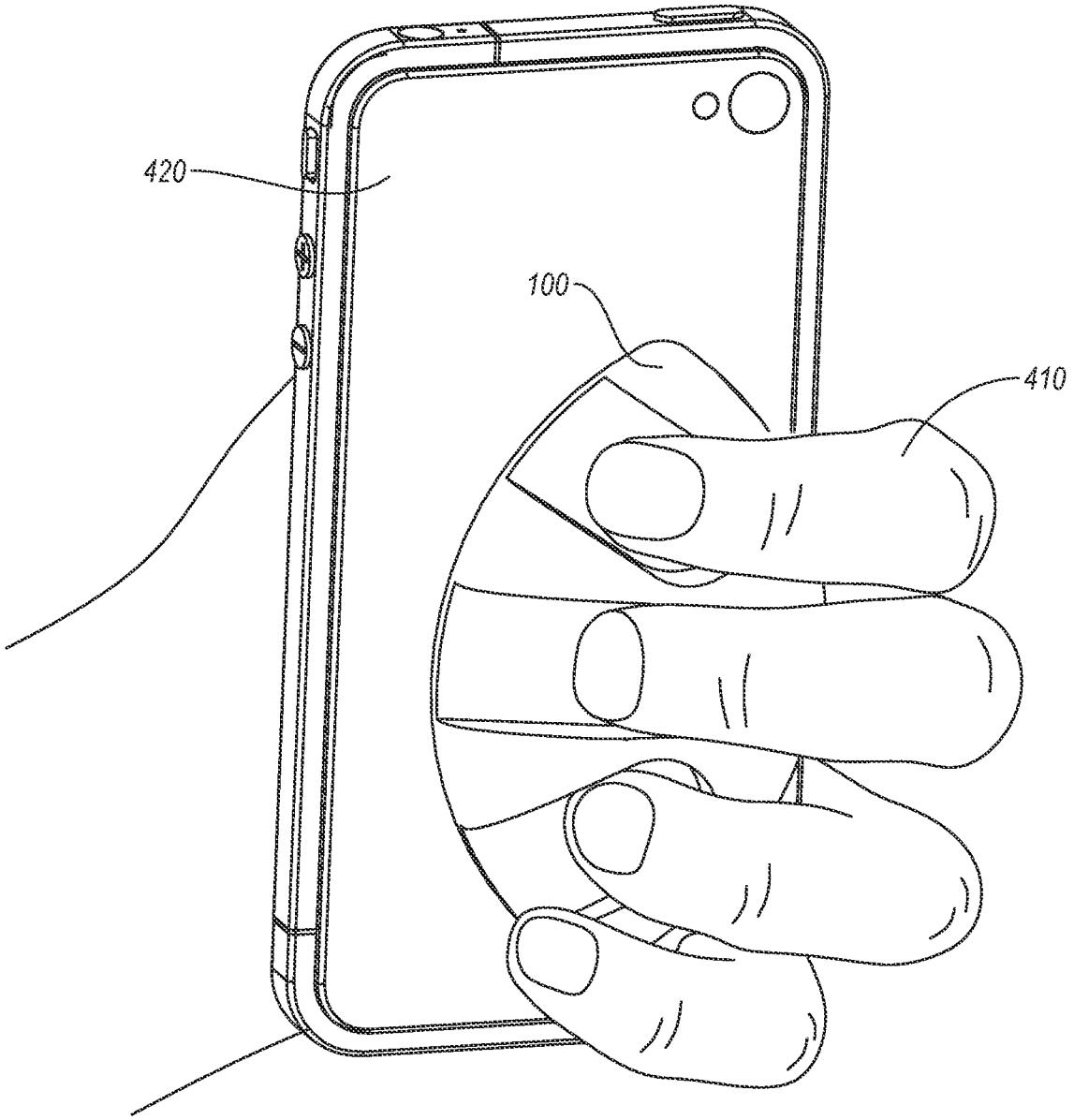
FIG. 4 illustrates a view of a finger grip attached to a handheld device and gripped by a user's fingers according to an embodiment.

Referring to FIG. 4, FIG. 4 illustrates a view of a finger grip attached to a handheld device and gripped by a user's fingers according to an embodiment. The finger grip 100 is oriented in a left-handed orientation for a left hand 410. Here, the index finger, the middle finger, and the ring finger of the left hand 410 is inserted into the finger slots of the finger grip 100, and the thumb naturally is positioned in the front of the handheld device 420 and may reach a large area of the touch screen of the handheld device 420. It is noted that the user may position its lower fingers as inserted into the finger slots of the finger grip 100 differently than as shown. For example, the middle finger, the ring finger, and the pinky may be inserted into the finger slots and the index finger may be otherwise free instead.

In an embodiment, the finger grip 100 may be used as a stand for the handheld device when attached to the handheld device. For example, the finger grip 100 may include a raised portion 120 (or other raised areas). As such, when the finger grip 100 is attached to a flat handheld device, a naturally raised angle is created, which raises the touch screen side of the handheld device at the angle, creating the stand for the handheld device (e.g., for viewing contents on the handheld device at a more comfortable angle for the user).

Figure 2A:
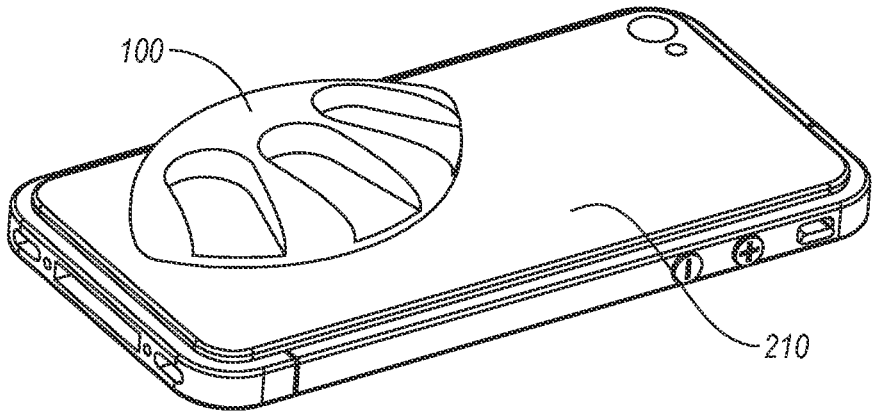
FIGS. 2A-2D illustrate exemplary views of a finger grip attached to handheld devices according to embodiments.
Figure 2B:
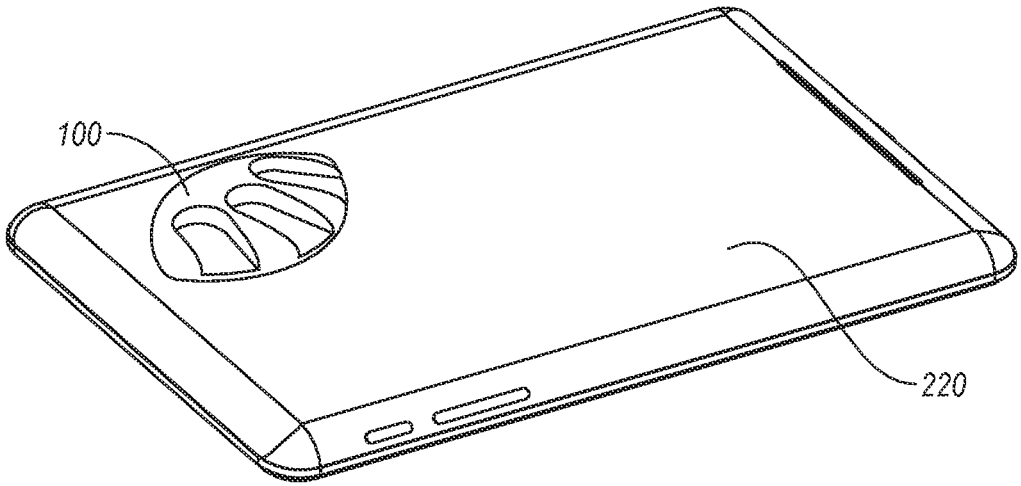
Figure 2C:
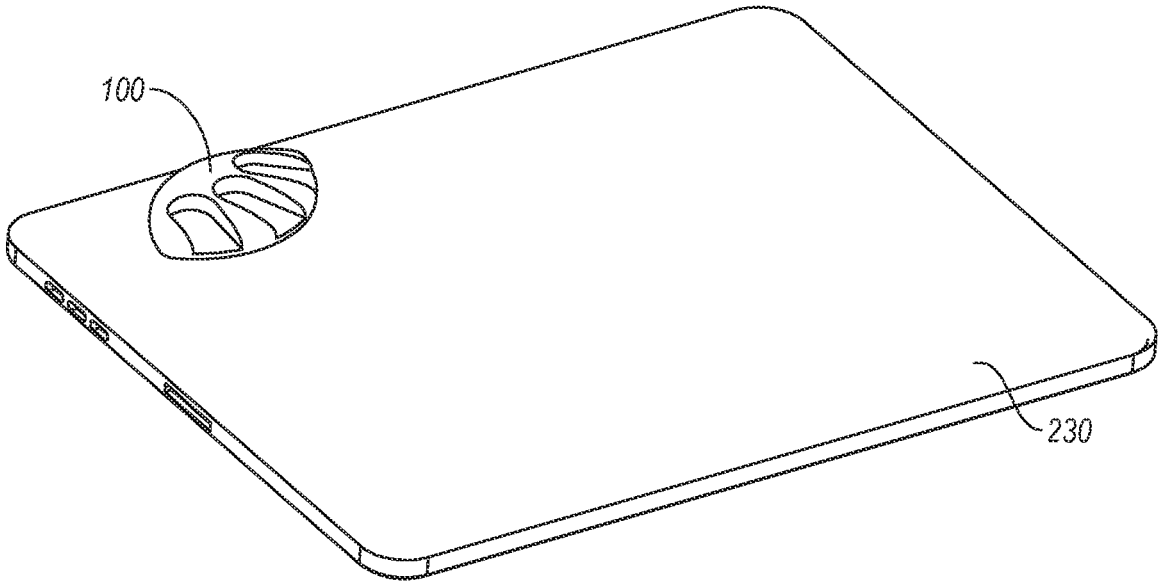
Figure 2D:
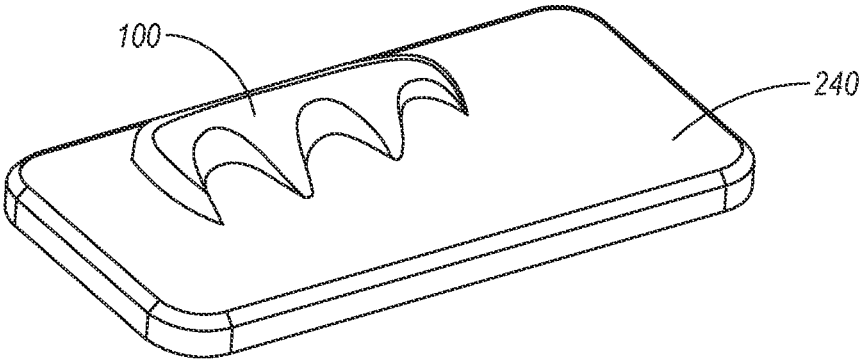

Referring to FIG. 2D, in an embodiment, the finger grip 100 may not necessarily include the raised portion 120. Further, the interior of finger slots 110 may directly lead to the back of the handheld devices (e.g., the finger slots 110 do not have a separate bottom portion).

In an embodiment, the finger grip 100 may include various jewelries, designs, and/or other accessories or art for aesthetics. In another embodiment, the finger grip 100 may include accessories and/or attachments for accessories such as belt and/or rope, stylus and/or stylus holder, mount for a removable swivel, and/or other accessories for utility functions.

In an embodiment, the finger grip 100 may have a specific design for aesthetics and/or utility. For example, the finger grip 100 may have various designs that appeal to different lifestyles. In one example, the finger grip 100 may have a football-shaped design for a football fan, where the finger grip 100 may have placements of the finger slots 110 and other elements that allows the user to grip the finger grip 100 like a football. In another example, the finger grip 100 may have a shoe-shaped design for a runner. In another example, the finger grip 100 may appeal to a climber by including various utility aspects such as attachments for a belt or designs for climbing specific operation (e.g., accommodating a specific hand and/or finger position of the user when the user accesses the handheld device while climbing, e.g., needing to grab the handheld device from a belt, while using common handheld device functions while climbing, e.g., the camera functions).

In an embodiment, the finger grip 100 may be specifically designed for users with hand or other physical ailments. For example, a user with carpel tunnel syndrome may need a finger grip that is made of a softer material, with the finger slots 110 positioned closer and at certain angles, and/or other accommodations.

In an embodiment, the finger grip 100 may be also used for achieving a grip on other handheld or small objects that can have the finger grip 100 attached.

Figure 3:
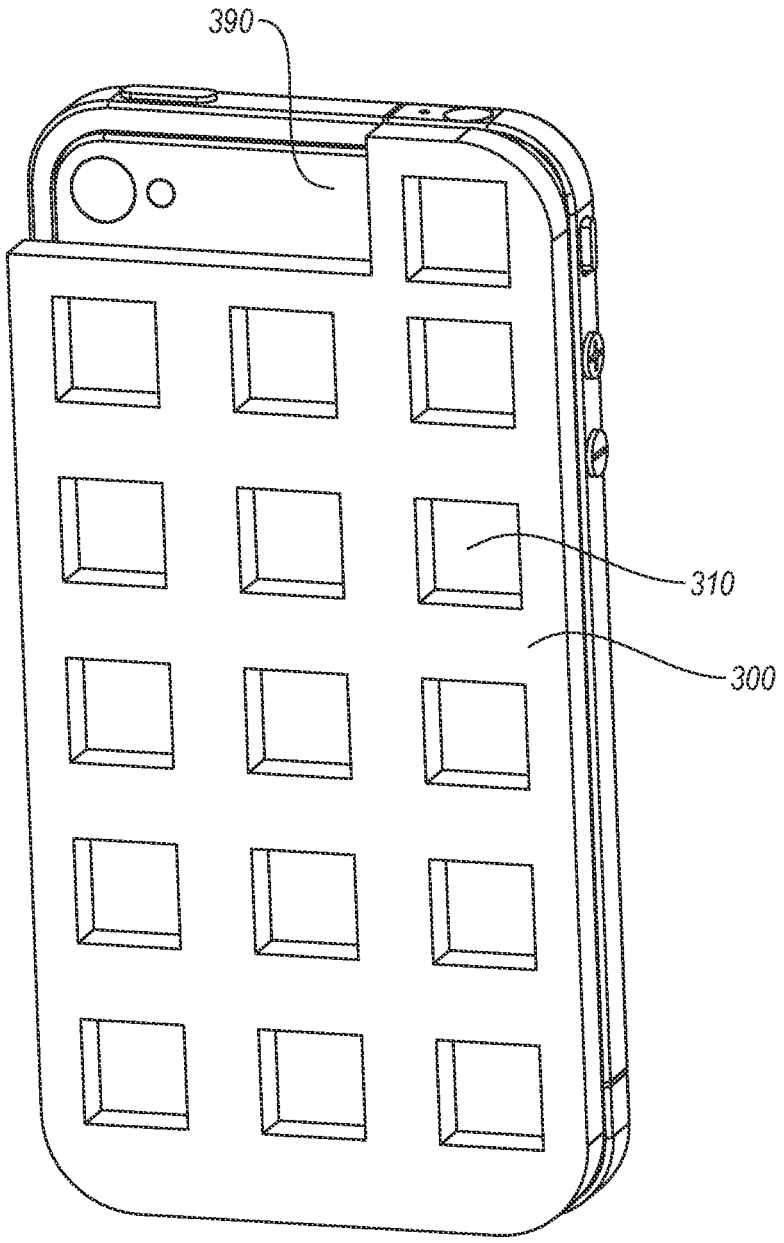
FIG. 3 illustrates a view of a finger grip attached to a handheld device according to an embodiment.

FIG. 3 illustrates a view of a finger grip attached to a handheld device according to an embodiment.

Referring to FIG. 3, in an embodiment, finger grip 300 includes a plurality of finger slots 310, and the finger grip 300 is attached to a large area of the handheld device 390.

In an embodiment, the finger slots 310 are numerous and occupies various locations of the finger grip 300. As such, the user may choose to place one or more fingers into certain finger slots 310 in order to grab and anchor the handheld device 390. An advantage to the finger grip 300 is that the user may move his or her fingers in the finger grip 300 in order to accommodate various positions of the user's hand and/or fingers. For example, the user's thumb may need to reach an area of the touch screen that is out of range of the user's current hand position. Consequently, the user may move the lower fingers to different finger slots 310 in order to change to a thumb position where he or she can reach the previously unreachable area of the touch screen. It is further note that, in an embodiment, other finger grips (e.g., finger grip 100) may include features of the finger grip 300, such as the arrangement of the finger slots 310.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this description, with each claim standing on its own as a separate preferred embodiment of the disclosure.

Moreover, though the description has included a description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A kit for an attachable grip for a small object, comprising:

a grip, wherein the grip comprises two or more slots, wherein each slot comprising a respective raised edge and an opened side, the respective raised edge comprises a respective back edge between two respective side edges, the opened side between the two respective side edges, and lengths of the respective side edges are longer than a depth of the respective raised edge, wherein each of the slots is configured to accommodate one or more lower fingers of a hand of a user, wherein the respective back edge is configured to provide a rest to the lower finger accommodated by a respective one of the slots;

one or more raised separation portions, each of the raised separation portions between two respective slots, and each of the raised separation portions adjoining the two respective slots at one of the side edges of each of the two respective slots;

a raised back portion, wherein each of the slots is depressed with respect to the respective raised separation portion, the raised back portion, and the respective raised edge; and a substantially flat back of the grip configured for attaching the grip to a site at a back of the object; and an instruction or aid for preparing an attachment of the grip to the site at the back of the object.

2. The kit of claim 1, wherein the instruction or aid comprises one or more pre-determined orientation or position on the back of the object for the finger grip.

3. The kit of claim 1, wherein the raised back portion is configured for providing support to the hand when the lower fingers are accommodated by the slots in the position.

4. The kit of claim 1, wherein the back of the grip comprises an attachment for attaching the grip to the site at the back of the object, the attachment being one or more of: an adhesive attachment, a glue attachment, a magnetic attachment, and a hook-and-loop attachment.

5. The kit of claim 1, wherein the instruction or aid comprises a video.

6. The kit of claim 1, wherein the grip comprises material being one or more of: foam, memory foam, plastic, and a composite material.

7. The kit of claim 1, wherein the grip comprises a structure of a monolithic piece of foam or plastic material.

8. A kit for an attachable grip for a small object, comprising:

a grip, wherein the grip comprises two or more slots, wherein each slot comprising a respective raised edge and an opened side, the respective raised edge comprises a respective back edge between two respective side edges, the opened side between the two respective side edges, and lengths of the respective side edges are longer than a depth of the respective raised edge, wherein each of the slots is configured to accommodate one or more lower fingers of a hand of a user, wherein the respective back edge is configured to provide a rest to the lower finger accommodated by a respective one of the slots;

one or more raised separation portions, each of the raised separation portions between two respective slots, and each of the raised separation portions adjoining the two respective slots at one of the side edges of each of the two respective slots;

a raised back portion, wherein each of the slots is depressed with respect to the respective raised separation portion, the raised back portion, and the respective raised edge; and a back of the grip configured for attaching the grip to the site at a back of the object.

9. The kit of claim 8, wherein the kit further comprises an instruction or aid for preparing an attachment of the grip to the site at the back of the small object.

10. The kit of claim 8, wherein the object comprises a handheld device.

11. The kit of claim 8, wherein the back of the grip comprises an attachment for attaching the grip to the site at the back of the object, the attachment being one or more of: an adhesive attachment, a glue attachment, a magnetic attachment, and a hook-and-loop attachment.

12. The kit of claim 8, wherein the grip comprises material being one or more of: foam, memory foam, plastic, and a composite material.

13. The kit of claim 8, wherein an interior of the slots comprises at least one of: a comfort and friction material.

14. The kit of claim 8, wherein the grip comprises a structure of a monolithic piece of foam or plastic material.

15. The kit of claim 8, wherein the grip is configured to be attached to the site at the back of the object at an angle to a side of the object.

16. The kit of claim 8, at least two of the slots are arranged at an angle.

17. The kit of claim 8, wherein a thumb of the hand has a reach on a range of sites at a front of the object when the lower fingers are accommodated by the slots in a position.

18. The kit of claim 8, further comprising an accessory for aesthetics or utility for the grip.

19. The kit of claim 18, further comprising an attachment for the accessory.

20. The kit of claim 8, wherein the grip is configured to accommodate an ailment.

* * * * *